US009831555B2

(12) United States Patent
Sakurai

(10) Patent No.: US 9,831,555 B2
(45) Date of Patent: Nov. 28, 2017

(54) ANTENNA DEVICE

(71) Applicant: Tyco Electronics Japan G.K., Kanagawa (JP)

(72) Inventor: Yohei Sakurai, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 439 days.

(21) Appl. No.: 14/153,599

(22) Filed: Jan. 13, 2014

(65) Prior Publication Data

US 2014/0198003 A1 Jul. 17, 2014

(30) Foreign Application Priority Data

Jan. 11, 2013 (JP) ..... 2013-003216

(51) Int. Cl.

| | |
|---|---|
| ***H01Q 1/24*** | (2006.01) |
| ***H01Q 5/378*** | (2015.01) |
| ***H01Q 5/321*** | (2015.01) |
| ***H01Q 5/371*** | (2015.01) |

(52) U.S. Cl.
CPC ..... *H01Q 5/378* (2015.01); *H01Q 5/321* (2015.01); *H01Q 5/371* (2015.01)

(58) Field of Classification Search
CPC ..... H01Q 1/243; H01Q 5/321; H01Q 5/378; H01Q 5/371; H01Q 9/145
USPC ..... 343/702, 846
See application file for complete search history.

(56) References Cited

U.S. PATENT DOCUMENTS

| | | | | |
|---|---|---|---|---|
| 6,081,242 | A * | 6/2000 | Wingo | H01Q 1/242 333/32 |
| 6,400,339 | B1 * | 6/2002 | Edvardsson | H01Q 1/242 343/702 |
| 6,529,170 | B1 | 3/2003 | Nishizawa et al. | |
| 6,650,294 | B2 * | 11/2003 | Ying | H01Q 1/243 343/700 MS |
| 7,423,598 | B2 * | 9/2008 | Bit-Babik | H01Q 1/243 343/700 MS |

(Continued)

FOREIGN PATENT DOCUMENTS

| | | |
|---|---|---|
| EP | 1608035 A1 | 12/2005 |
| EP | 2418728 A1 | 2/2012 |

(Continued)

OTHER PUBLICATIONS

"Small Antennas Based on CRLH Structures", IEEE Antennas and Propagation Magazine, vol. 53, No. 2, Apr. 2011, 16 pages.

(Continued)

*Primary Examiner* — Brian Young
(74) *Attorney, Agent, or Firm* — Barley Snyder

(57) ABSTRACT

An antenna device is provided and includes a circuit board, a first linear antenna, and a second linear antenna. The circuit board includes a grounding pattern and a feeding point insulated from the grounding pattern. The first linear antenna is connected to the grounding pattern and includes a first inductive element positioned between distal ends of the first linear antenna. The second linear antenna is connected to the feeding point and capacitively coupled to one of the distal ends of the first linear antenna. The second linear antenna includes a second inductive element positioned proximate a middle section of the second linear antenna.

14 Claims, 3 Drawing Sheets

(56) References Cited

U.S. PATENT DOCUMENTS

| | | | | |
|---|---|---|---|---|
| 8,436,774 | B2 * | 5/2013 | Wong | H01Q 1/243 343/700 MS |
| 8,547,283 | B2 * | 10/2013 | Wong | H01Q 1/243 343/700 MS |
| 8,823,592 | B2 * | 9/2014 | Huynh | H01Q 1/243 343/700 MS |
| 9,431,708 | B2 * | 8/2016 | Orsi | H01Q 5/35 |
| 9,496,614 | B2 * | 11/2016 | Bringuier | H01Q 1/521 |
| 2012/0162036 | A1 | 6/2012 | Yanagi et al. | |

FOREIGN PATENT DOCUMENTS

| | | | |
|---|---|---|---|
| EP | 2562871 | A1 | 2/2013 |
| JP | 200520228 | A | 1/2005 |
| WO | 2004025778 | A1 | 3/2004 |
| WO | 2010137061 | A1 | 12/2010 |

OTHER PUBLICATIONS

European Search Report, Application No. EP1415019, dated Apr. 22, 2014, 11 pages.
Japanese Office Action, dated Jul. 15, 2016, 3 pages.
Abstract of WO2010137061, dated Dec. 2, 2010, 2 pages.

* cited by examiner

ANTENNA DEVICE

CROSS-REFERENCE TO RELATED APPLICATIONS

This application claims the benefit of the filing date under 35 U.S.C. §119(a)-(d) of Japanese Patent Application No. 2013-003216, filed Jan. 11, 2013.

FIELD OF THE INVENTION

The invention relates to an antenna device and, in particular, to an antenna device for a wireless communication device.

BACKGROUND

In the publication, "Small Antennas Based on CRLH Structures", IEEE Antennas and Propagation Magazine, Vol. 53, No. 2, April 2011, an antenna device having a wide bandwidth design is disclosed, wherein the design includes application of a composite right-left-hand "CRLH-based" RF design to print penta-band handset antennas directly on the printed circuit board (PCS), and balanced-antennas for Wi-Fi access points.

An antenna device 101 based on the CRLH structure is shown in FIGS. 3A and 3B, for example, while FIG. 4 shows a relationship between return loss and frequency in the antenna device shown in FIGS. 3A and 3B.

The antenna device 101 includes grounding patterns 103 on front and back sides of a board 102. A top patch 104 is provided on the front side of the board 102, and this top patch 104 is connected to the grounding pattern 103 on the back side via a receiving passageway 106 and a line 105. Further, a feeding point 107 insulated from the grounding pattern 103 is provided on the front side of the board 102, and a conductive pad 108 extends from this feeding point 107. The conductive pad 108 extends from the feeding point 107 and is capacitive coupled with the top patch 104 leaving a predetermined gap therefrom. The shape of the top patch 104, the gap distance between the conductive pad 108 and the top patch 104 in capacitive coupling, and the length of the line 105 determine a resonant frequency and a bandwidth on a low frequency side (a side denoted by a reference sign A in FIG. 4) of a first-order mode.

On the other hand, on the front side of the board 102, a meander line 109 extends from the middle of the conductive pad 108 in a direction opposite to the top patch 104. The meander line 109 is formed by folding back an elongated conductive pad many times. The shape of the meander line 109 determines a resonant frequency and a bandwidth on a high frequency side of a first-order mode (the side denoted by a reference sign B in FIG. 4) and those of third-order to fifth-order modes (the third-order mode is denoted by a reference sign C in FIG. 4).

By capacitive-coupling the resonance on the low frequency side of the first-order mode and resonance on the high frequency side of the first-order mode, a wider bandwidth can be obtained than in the case of using only resonance on the low frequency side.

However, the antenna device 101 shown in FIGS. 3A and 3B has the following problems, among others.

That is, adjustment of the resonant frequency on the high frequency side of the first-order mode is performed by changing the length, width, and pitch of the meander line 109, but such a problem is involved that the adjustment is complicated and difficult. Similarly, adjustment of the resonant frequency on the low frequency side of the first-order mode is performed by changing the lengths and shape of the top patch 104 and the line 105, but the adjustment is also complicated and difficult.

Further, adjustment of the bandwidth on the high frequency side of the first-order mode is performed by changing the width and pitch of the meander line 109, but the adjustment is also complicated and difficult.

Similarly, adjustment of the bandwidth on the low frequency side of the first-order mode is performed by changing the shape of the top patch 104 and the line width of the line 105, but the adjustment is also complicated and difficult.

In addition, adjustment of the capacitive coupling of the first-order mode is performed by changing the interval between the conductive pad 108 and the top patch 104, but the adjustment is also complicated and difficult.

SUMMARY

Therefore, the present invention has been made in view of the above problems and an object, among others, thereof is to provide an antenna device that can easily adjust the resonant frequency and the bandwidth of the first-order mode and that has a wider bandwidth characteristic of a bandwidth.

The antenna device includes a circuit board, a first linear antenna, and a second linear antenna. The circuit board includes a grounding pattern and a feeding point insulated from the grounding pattern. The first linear antenna is connected to the grounding pattern and includes a first inductive element positioned between distal ends of the first linear antenna. The second linear antenna is connected to the feeding point and capacitively coupled to one of the distal ends of the first linear antenna. The second linear antenna includes a second inductive element positioned proximate a middle section of the second linear antenna.

BRIEF DESCRIPTION OF THE DRAWINGS

An exemplary embodiment of the invention will now be described with reference to the accompanying drawings wherein.

DETAILED DESCRIPTION OF THE EMBODIMENT(S)

An embodiment of an antenna device 1 of the present invention will be described below with reference to the drawings.

Figure 1:
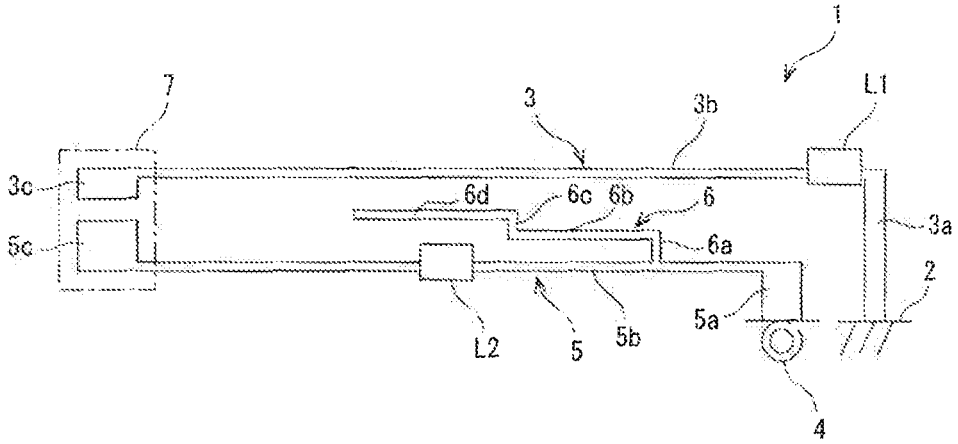
FIG. 1 is a schematic diagram of an antenna device according to the invention.

The antenna device 1 shown in FIG. 1 may be used in a wireless communication device, such as a mobile phone, a smartphone, or a tablet computer, and provided with a grounding pattern 2 on a board (not shown). A first linear antenna 3 is connected to the grounding pattern 2. This first linear antenna 3 includes a first linear antenna portion 3*a* and a second linear antenna portion 3*b*. The first linear antenna portion 3*a* extends unidirectional manner and linearly from the grounding pattern 2. The second linear antenna portion 3*b* extends linearly in a direction orthogonal to the first linear antenna portion 3*a* from a distal end of the first linear antenna portion 3*a*.

Also, a feeding point 4 insulated from the grounding pattern 2 is provided on the board. A second linear antenna 5 is connected to the feeding point 4. The second linear antenna 5 includes a first linear antenna portion 5*a* and a second linear antenna portion 5*b*. The first linear antenna portion 5*a* extends in an unidirectional manner and linearly from the feeding point 4. The second linear antenna portion 5*b* extends linearly in a direction orthogonal to the first linear antenna portion 5*a* (leftward in FIG. 1) from a distal end of the first linear antenna portion 5*a*.

The first linear antenna 3 and the second linear antenna 5 are capacitive coupled at a capacitive coupling portion 7 at their distal ends thereof. Specifically, a rectangular capacitive coupling portion 3*c* wider than the second linear antenna portion 3*b* is provided at a distal end of the second linear antenna portion 3*b* of the first linear antenna 3. Similarly, a rectangular capacitive coupling portion 5*c* wider than the second linear antenna portion 5*b* is provided at a distal end of the second linear antenna portion 5*b* of the second linear antenna 5. The rectangular capacitive coupling portion 3*c* provided to the first linear antenna 3 and the rectangular capacitive coupling portion 5*c* provided to the second linear antenna 5 are positioned so as to face each other with a predetermined gap provided there between.

Figure 2:
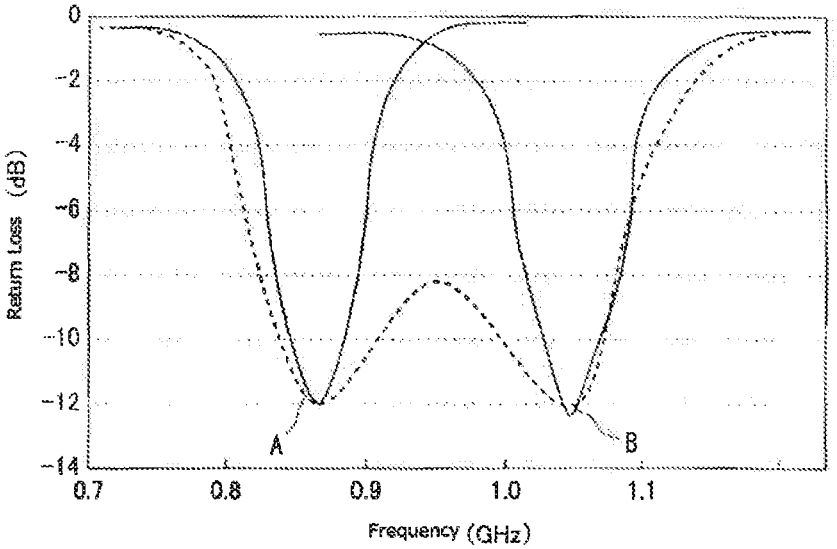
FIG. 2 is a diagram showing a relationship between return loss and frequency in the antenna device shown in FIG. 1.

Thus, the first linear antenna 3 connected to the grounding pattern 2 and the second linear antenna 5 connected to the feeding point 4 are capacitively coupled at their distal ends. Therefore, resonance on a low frequency side of a first-order mode (A in FIG. 2) and resonance on a high frequency side of the first-order mode (B in FIG. 2) are capacitively coupled. Thereby, a wider bandwidth (a broken line in FIG. 2) can be obtained than in the case of using only resonance on the low frequency side (solid line in FIG. 2).

In addition, an inductive element L1 is interposed proximate to a middle section of the first linear antenna 3, (i.e., along an end on the first linear antenna portion 3*a* side of the second linear antenna portion 3*b*). For instance, the inductive element L1 may be provided at a distance of about one-fifth of the entire length of the first linear antenna 3 from the grounding pattern 2. Further, an inductive element L2 is interposed proximate to a middle section of the second linear antenna 5, (i.e., in a middle portion of the second linear antenna portion 5*b*). For instance, the inductive element L2 may be provided in the vicinity of the center of the entire length of the second linear antenna 5. The inductive elements L1, L2 can be formed of inductors in the form of a chip part or conductive pattern.

Here, the inductance of the inductive element L1, the gap distance between the rectangular capacitive coupling portions 3*c* and 5*c* in capacitive coupling, and the length of the first linear antenna 3 determine a resonant frequency and a bandwidth on the low frequency side (A in FIG. 2) of the first-order mode.

Therefore, the resonant frequency on the low frequency side of the first-order mode can be adjusted by adjusting the inductance of the inductive element L1 interposed in the middle section of the first linear antenna 3. In this regard, unlike conventional techniques, without requiring such adjustment as changing the shape of a top patch or the length and width of a line, the resonant frequency and bandwidth on the low frequency side of the first-order mode can be easily adjusted.

Further, the inductance of the inductive element L2 and the length of the second linear antenna 5 determine a resonant frequency and a bandwidth on the high frequency side (B in FIG. 2) of the first-order mode and those of the third-order to fifth-order modes (not shown).

Therefore, the resonant frequency on the high frequency side of the first-order mode and those of the third-order to fifth-order modes can be adjusted by adjusting the inductance of the inductive element L2 interposed in the middle part of the second linear antenna 5. In this regard, unlike conventional techniques, without requiring such adjustment as changing the length, width, and pitch of a meander line, the resonant frequency and bandwidth on the high frequency side of the first-order mode and those of the third-order to fifth-order modes can be easily adjusted. In particular, the resonant frequency on the high frequency side of the first-order mode and those of the third-order to fifth-order modes can be lowered to desired resonant frequencies by adjusting the inductance of the inductive element L2.

In addition, the first antenna 3 and the second antenna 5 are made linear and the inductive elements L1 and L2 are interposed in these antennas 3 and 5, respectively, so that the resonant frequencies of the first-order mode and the third-order to fifth-order modes can be adjusted. Thus, since a conductive pad having a shape folded many times, such as the conventional meander line 109, is not used, the antenna device can be downsized.

Further, as shown in FIG. 1, the antenna device 1 includes a third antenna 6 that extends from a middle section of the second linear antenna 5, (i.e., from a position between the feeding point 4 and the inductive element L2 in the second linear antenna portion 5*b*). The third antenna 6 may extend from a position of one-fourth $\lambda$ of the third-order mode of the second linear antenna 5 from the feeding point 4. The third antenna 6 includes a first linear portion 6*a* that extends linear in a unidirectional manner from the second linear antenna portion 5*b* of the second linear antenna 5. Further, the third antenna 6 includes a second linear portion 6*b* extending linearly and orthogonal to the first linear portion 6*a* from a distal end of the first linear portion 6*a*. Further, the third antenna 6 includes a third linear portion 6*c* extending linearly in a unidirectional manner from a distal end of the second linear portion 6*b*. Moreover, the third antenna 6 includes a fourth linear portion 6*d* extending linearly and orthogonal to the third linear portion 6*c* from a distal end of the third linear portion 6*c*. By providing the third linear portion 6*c* and the fourth linear portion 6*d*, the third antenna 6 is prevented from coming into contact with the inductive element L2.

By adjusting the length or shape of the third antenna 6, the resonant frequencies and bandwidths of the third-order to fifth-order modes can be adjusted independently without affecting the first-order mode. In particular, the resonant frequencies of the third-order to fifth-order modes can be lowered to desired resonant frequencies by adjusting the length or shape of the third antenna 6.

Figure 3:
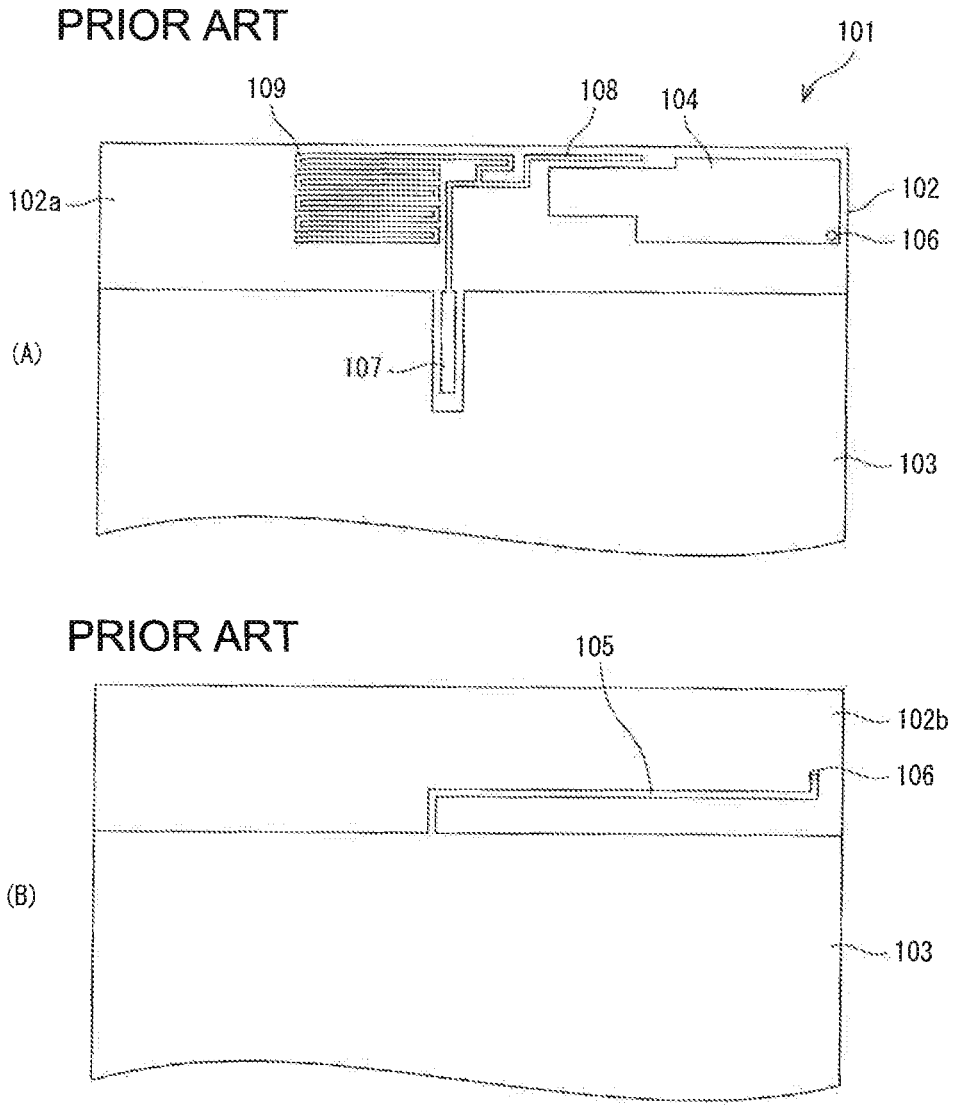
FIG. 3A is a plan view of a known antenna device based on a known CRLH structure.
FIG. 3B is a bottom view of the known antenna device of FIG. 3A.
Figure 4:
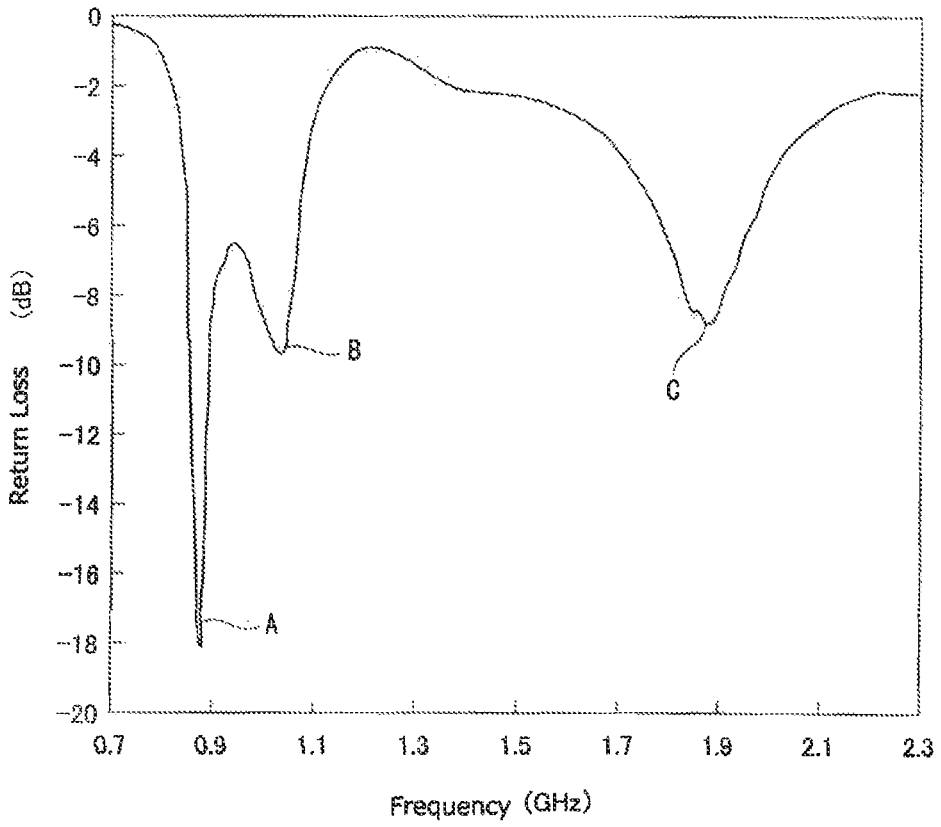
Fig. 4 PRIOR ART
FIG. 4 is a graph showing a relationship between return loss and frequency in the antenna device shown in FIGS. 3A and 3B.

It should be noted that in the capacitive coupling portion 7 between the first linear antenna 3 and the second linear antenna 5, one side of the rectangular capacitive coupling portion 3*c* on the first linear antenna 3 side and one side of the rectangular capacitive coupling portion 5*c* on the second linear antenna 5 side are positioned to face each other with a predetermined gap therebetween. Therefore, a region required for capacitive coupling is small, so that capacitance can be adjusted only by adjusting the gap distance between and facing lengths of the one side of the rectangular capacitive coupling portion 3*c* and the one side of the rectangular capacitive coupling portion 5*c* facing each other. In contrast, in the capacitive coupling portion of the conventional antenna device 101 shown in FIG. 3, the top patch 104 is formed in a rectangular shape, and the conductive pad 108 is formed in a substantially-L shape so as to face the top patch 104 at a corner of the top patch 104. Thus, one side of the top patch 104 and one side of the conductive pad 108 face each other, and another side orthogonal to the one side of the top patch 104 and another side orthogonal to the one side of the conductive pad 108 face each other. Therefore, a region required for capacitive coupling is large, and capacitance adjustment is complicated.

While an embodiment of the preset invention has been described above, the present invention is not limited to the described embodiment, and can be altered or modified variously.

For example, the first linear antenna 3 to be limited to having the first linear antenna portion 3*a* and the second linear antenna portion 3*b* as described. Similarly, the second linear antenna 5 need to be limited to one provided with the first linear antenna portion 5*a* and the second linear antenna portion 5*b*. In this regard, the "linear antenna" of the first linear antenna 3 and the second linear antenna 5 means an antenna including a linear antenna portion extending in a unidirectional manner and linearly in an elongated fashion.

Further, the inductive elements L1, L2 only need to be interposed in the respective middle parts of the first linear antenna and the second linear antenna, and are not limited to the example shown in FIG. 1.

What is claimed is:

1. An antenna device comprising:

a circuit board having a grounding pattern and a feeding point insulated from the grounding pattern;

a first linear antenna having a first linear antenna portion connected to and extending linearly from the grounding pattern, a second linear antenna portion extending from a distal end of the first linear antenna portion, a first capacitive coupling portion wider than the second linear antenna portion disposed at a distal end of the second linear antenna portion, and a first inductive element;

a second linear antenna having a third linear antenna portion connected to and extending from to the feeding point, a fourth linear antenna portion extending from a distal end of the third linear antenna portion, a second capacitive coupling portion wider than the fourth linear antenna portion disposed at a distal end of the fourth linear antenna portion and capacitively coupled to the first capacitive coupling portion, and a second inductive element; and a third linear antenna extending from the second linear antenna and positioned between the first linear antenna and the second linear antenna.

2. The antenna device according to claim 1, wherein the first and second inductive elements are chip inductors.

3. The antenna device according to claim 1, wherein the first and second inductive elements are conductive patterns.

4. The antenna device according to claim 1, wherein the second linear antenna portion extends orthogonal from the distal end of the first linear antenna portion.

5. The antenna device according to claim 1, wherein the fourth linear antenna portion extends orthogonal from the distal end of the third linear antenna portion.

6. The antenna device according to claim 5, wherein the third antenna includes a fifth linear portion extending from the fourth linear antenna portion.

7. The antenna device according to claim 6, wherein the third antenna further includes a sixth linear portion extending linearly and orthogonal to the fifth linear portion.

8. The antenna device according to claim 7, wherein the third antenna further includes a seventh linear portion extending linearly from a distal end of the sixth linear portion.

9. The antenna device according to claim 8, wherein the third antenna further includes an eighth linear portion extending orthogonal to the seventh linear portion from a distal end thereof.

10. The antenna device according to claim 1, wherein the first inductive element is positioned on an end of the second linear antenna portion.

11. The antenna device according to claim 1, wherein the second inductive element is positioned proximate a middle section of the fourth linear antenna portion.

12. An antenna device comprising:

a circuit board having a grounding pattern and a feeding point insulated from the grounding pattern;

a first linear antenna having a first linear antenna portion connected to and extending linearly from the grounding pattern, a second linear antenna portion extending orthogonally from a distal end of the first linear antenna portion, and a first capacitive coupling portion disposed at a distal end of the second linear antenna portion;

a second linear antenna having a third linear antenna portion connected to and extending from the feeding point, a fourth linear antenna portion extending orthogonally from a distal end of the third linear antenna portion, the fourth linear antenna portion extending parallel to the second linear antenna portion, and a second capacitive coupling portion disposed at a distal end of the fourth linear antenna portion and capacitively coupled to the first capacitive coupling portion; and a third linear antenna extending from the second linear antenna and positioned between the first linear antenna and the second linear antenna.

13. The antenna device according to claim 12, wherein the third linear antenna extends from the fourth linear antenna portion.

14. The antenna device according to claim 13, wherein the first linear antenna portion extends parallel to the third linear antenna portion.

* * * * *